United States Patent [19]

Lal

[11] 4,412,791

[45] Nov. 1, 1983

[54] REFRIGERATION COMPRESSOR APPARATUS AND METHOD OF ASSEMBLY

[75] Inventor: Mahendra Lal, Sidney, Ohio

[73] Assignee: Copeland Corporation, Sidney, Ohio

[21] Appl. No.: 207,611

[22] Filed: Nov. 17, 1980

Related U.S. Application Data

[63] Continuation of Ser. No. 10,749, Feb. 9, 1979, abandoned, which is a continuation of Ser. No. 767,325, Feb. 19, 1977, abandoned.

[51] Int. Cl.[3] ..... F04B 35/04

[52] U.S. Cl. ..... 417/312; 417/360; 417/366; 417/415; 417/902; 292/24

[58] Field of Search ..... 417/360, 902, 312, 366; 62/296, 505; 310/42, 87

[56] References Cited

U.S. PATENT DOCUMENTS 3,169,696 2/1965 Warner ..... 417/902 X

FOREIGN PATENT DOCUMENTS 50-49707 9/1975 Japan .
51-13013 5/1976 Japan .

*Primary Examiner*—Richard E. Gluck
*Attorney, Agent, or Firm*—Harness, Dickey & Pierce

[57] ABSTRACT

There is disclosed herein an improved means and method for securing a shroud to one end of a motor in a refrigeration compressor. A fastening device is secured to one end of the motor stator by fasteners securing the stator to the compressor housing and is provided with a peripheral flange portion adapted to be folded into engagement with portions of the shroud so as to retain the shroud in position. The stator may therefore be easily accurately positioned with respect to the rotor to assure a uniform circumferential air gap therebetween prior to assembly of the shroud thereto. Additionally, a suction gas directing member may be provided on a portion of the shroud to efficiently direct the suction gas into the motor compartment. In one embodiment, the suction gas is directed through the motor air gap to the compressor via passage means in the compressor housing so as to cool the motor. In another embodiment, the suction gas is directed across the shrouded end of the motor and through external conduit members to the compressor.

10 Claims, 6 Drawing Figures

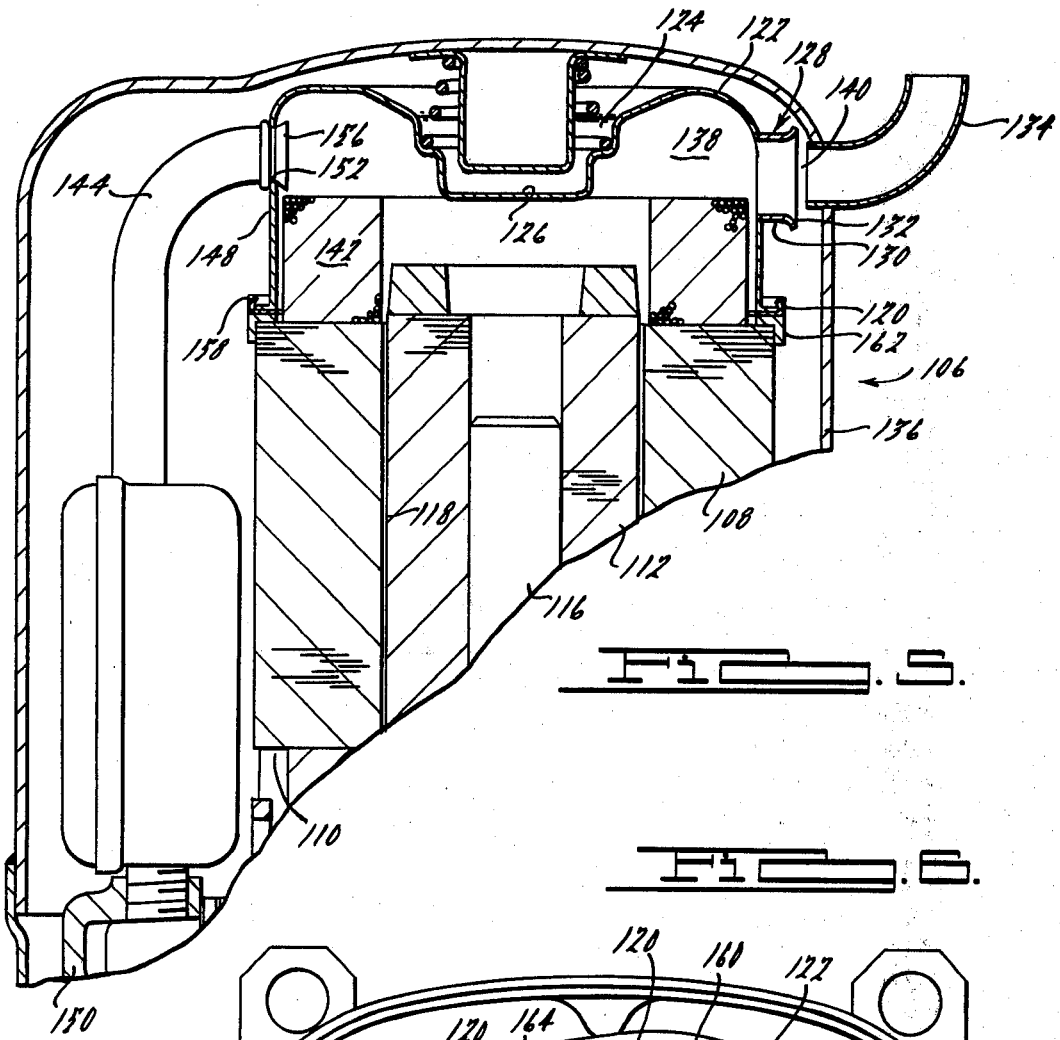
FIG. 5.
FIG. 6.
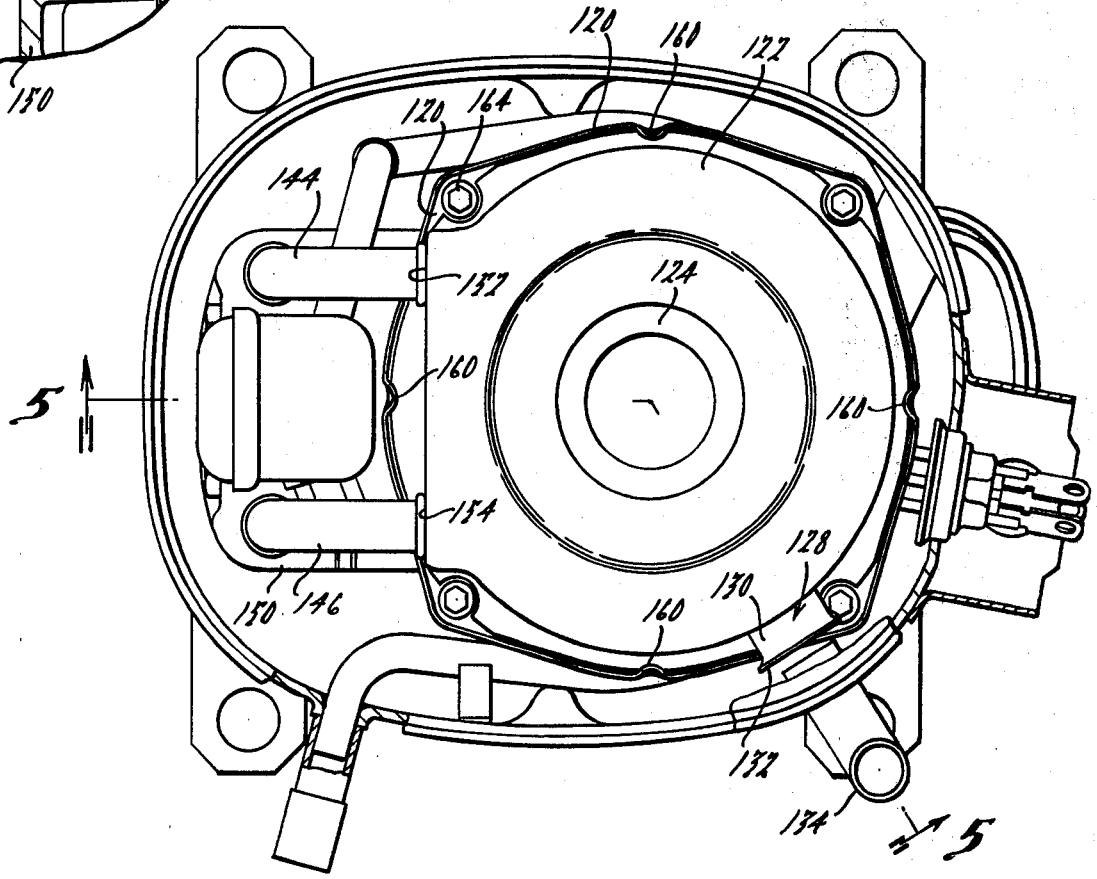

REFRIGERATION COMPRESSOR APPARATUS AND METHOD OF ASSEMBLY

This is a continuation of application Ser. No. 10,749, filed Feb. 9, 1979, now abandoned, which is a continuation of Ser. No. 767,325, filed Feb. 19, 1977, now abandoned.

BACKGROUND AND SUMMARY OF THE INVENTION

The present invention relates generally to refrigeration compressors and more particularly to hermetic type refrigeration compressors in which the compressor and driving motor are disposed interiorly of a hermetically sealed shell.

In hermetic compressors, it is often desirable to provide a shroud over one end of the driving motor for various reasons, such as to obtain a suction gas muffling effect therefrom and/or to serve as a conduit member for insuring that all of the suction gas entering the compressor is passed over at least a portion of the motor to thereby serve to cool same. Typically such compressors have a housing containing the actual compressing means, usually a rotary or reciprocating piston and cylinder, and in which a crankshaft is rotatably journaled. Generally, the crankshaft extends outwardly from one end of this housing and has a motor rotor secured thereto. A motor stator surrounds the rotor and will generally be secured to the housing such as by a plurality of bolts extending longitudinally through or adjacent the stator. Manufacturing tolerances within the various components of such compressors often result in the rotor position varying slightly from one compressor to another, thus necessitating that each stator be individually positioned with respect to the rotor to set the air gap therebetween. While setting this air gap may not present a problem in those hermetic compressors which do not employ a shroud over the open end of the motor, this can be a relatively difficult task in those compressors having such a shroud because the shroud covers the stator fasteners. In such cases the shroud may be secured to the stator or housing structure by either a press fit or providing additional fasteners. When a press fit arrangement is employed, it is generally necessary to machine a seating shoulder portion on the stator or housing to assist in locating the shroud thus incurring additional expense in both time and labor to perform this operation. Further, the shroud must be accurately formed and sized to the particular stator or housing to insure a snug frictional engagement therebetween so as to prevent vibrations from dislodging the shroud during operation of the compressor. Similarly, the use of additional fasteners engaging the stator or housing also require an additional machining operation to provide openings therein to receive these fasteners. Further, additional time and expense will be required to assemble these fasteners.

Shrouds are generally employed in such compressors to attenuate suction noise emanating from the pressure pulses produced by the compressor as well as to direct substantially all of the suction gas over at least a portion of the motor for cooling. Thus, it is necessary to provide an inlet opening in the shroud. In one such arrangement, a conduit is provided through the shell to deliver suction gas directly into the shroud. This has the disadvantage, however, in that lubricant entrained in the suction gas will be directed into the motor compartment and may be carried into the compressor itself. Similarly any liquid refrigerant may also flow directly into the motor compartment. These liquids may cause slugging of the compressor as well as placing an undue strain upon the motor.

In other arrangements a suction gas inlet is located in the side of the shell a substantial distance from the shroud, and an inlet opening is provided somewhere through the shroud wall. This construction has the advantage that it employs the volume between the outer shell and motor compressor unit as an expansion chamber to help separate the lubricant and any liquid refrigerant; however, because of the length of the suction gas flow path, some losses will occur.

The present invention provides a shroud and means for attaching this shroud to the stator structure which overcome the problems associated with these prior constructions. In the present invention, a fastening device having an upwardly extending flange portion is placed on top of the motor stator structure and secured thereto by the same bolts employed to secure the stator structure to the compressor housing portion. The flange portion of the fastening device may then be folded over portions of the shroud member after the air gap has been properly set. As the shroud does not require any additional fasteners nor does it depend upon loosening and removal of the stator securing bolts subsequent to the setting of the air gap, assembly time is substantially reduced. Further, no additional high precision machining operations are required on either the housing or stator because the fastening device is both positioned and retained by the stator securing bolts.

Additionally, the present invention resides in the optional provision of a suction gas directing member on a vertically extending side wall portion of the motor shroud, the gas directing member being aligned with a suction gas inlet through the shell. In one embodiment, the suction gas flows across the end windings of the motor and through conduit members extending to and communicating with the compressor means in the housing to which the motor is secured. In another embodiment, the suction gas flows through the air gap between the rotor and stator structure of the motor downwardly and through a passage means provided in the housing to the compressor. In both embodiments, the suction gas directing member is positioned in an aligned spaced relationship with the suction inlet in the shell so as to smoothly direct the suction gas into the shroud while also providing an expansion space therebetween which effectively separates the oil therefrom thus preventing such lubricant from interfering with or otherwise affecting the operation of the motor and/or compressor.

Additional advantages and features of the present invention will become apparent from the following detailed description of the preferred embodiment taken in conjunction with the attached drawings and the claims appended hereto.

BRIEF DESCRIPTION OF THE DRAWINGS

FIG. 5 is a side elevational view of a portion of another embodiment of the present invention similar to that of FIG. 1 having the outer shell and portions of the compressor broken away; and FIG. 6 is a top plan view of the refrigeration compressor of FIG. 5 with portions removed therefrom.

DESCRIPTION OF THE PREFERRED EMBODIMENTS

Figure 1:
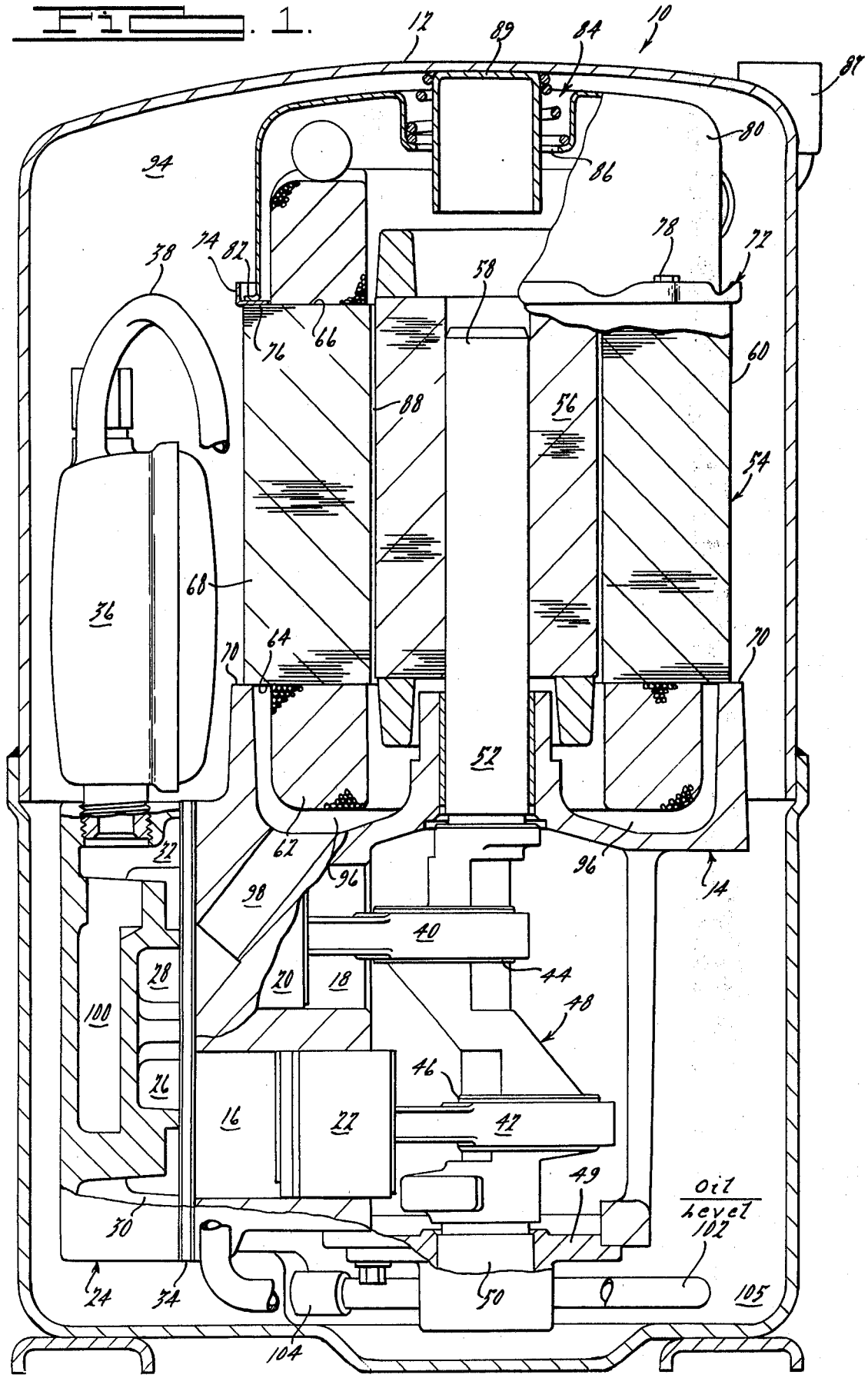
FIG. 1 is a side elevational view of a hermetic refrigeration compressor embodying the present invention shown mostly in section and with portions broken away.

Referring now to FIG. 1, there is shown therein a refrigeration compressor 10 of the hermetically sealed type enclosed within an outer shell 12. The refrigeration compressor includes a lower housing 14 having a pair of cylinders 16 and 18 with pistons 20 and 33 reciprocatingly disposed therein. A cylinder head 24 is secured over these cylinders and has chambers 26 and 28 provided therein for conducting suction gas to each of cylinders 16 and 18 and chambers 30 and 32 for receiving the compressed discharged gas from these pistons. A valve plate 34 having appropriate valving means is provided between the cylinder head 24 and the housing 14. A discharge muffler 36 is secured to the cylinder head 24 and receives compressed discharge gas therefrom which passes therethrough and exits through discharge conduit member 38 extending outward from the upper portion thereof. Each of the two pistons 20 and 22 includes connecting rods 40 and 42 journaled to angularly displaced throws 44 and 46 provided on a vertically disposed crankshaft 48. Crankshaft 48 has its lower end 50 journaled within a bearing retainer 49 secured to housing 14 and an upper intermediate portion 52 journaled within a portionof the housing 14. Suitable bearings are provided at each of these journal locations to allow crankshaft 48 to freely rotate with respect to both housing 14 and connecting rods 40 and 42.

An electrical driving motor 54 is disposed above the housing and includes a rotor member 56 which is secured to the outwardly projecting end 58 of crankshaft 48 and a stator structure 60. Stator structure 60 is generally cylindrical in shape completely surrounding rotor 56 and includes a plurality of windings 62 extending outward from opposite longitudinal ends 64 and 66 of a core structure 88. Core structure 68 is supported by engagement of end 64 with an annular upwardly projecting shoulder portion 70 of the housing 14. A fastening device 72 having an outer upwardly extending flange portion 74 and a perpendicularly disposed inwardly projecting relatively flat body portion 76 is positioned with portion 76 engaging the upper end 66 of core structure 68 and is secured thereto by a plurality of threaded fasteners 78 which extend through longitudinally extending bores provided in the stator structure and into threaded engagement with shoulder portion 70 of housing 14. Fasteners 78 also secure stator structure 60 to shoulder portion 70.

A generally cup-shaped shroud member 80 encloses the upper end of the motor structure and is provided with a peripheral lower flange portion 82 extending radially outward therefrom and engaging body portion 76 of the fastening device 72. The shroud member also has a centrally disposed recess 84 provided in the top portion thereof with a relatively large diameter opening 86 disposed in the bottom thereof. A second substantially smaller inverted cupshaped member 89 is secured to the shell directly above recess 84 and extends downwardly through opening 86 and partially into the area enclosed by shroud member 80. This shroud member 80, in combination with the core structure 68 and the upper portion of a supporting housing 14, defines a motor compartment separate from the interior of the outer shell 12 with the only communication therebetween being through the relatively large diameter opening 86 provided in the bottom of recess 84.

The outer shell 12 is also provided with a suction gas inlet 87 securely attached thereto along the lateral side portion. While suction gas inlet 87, as illustrated, is in the form of a relatively short elbow which is adapted to have a supply line connected thereto such as a line extending from an evaporator, any suitable suction gas inlet means desired may be employed.

Figure 2:
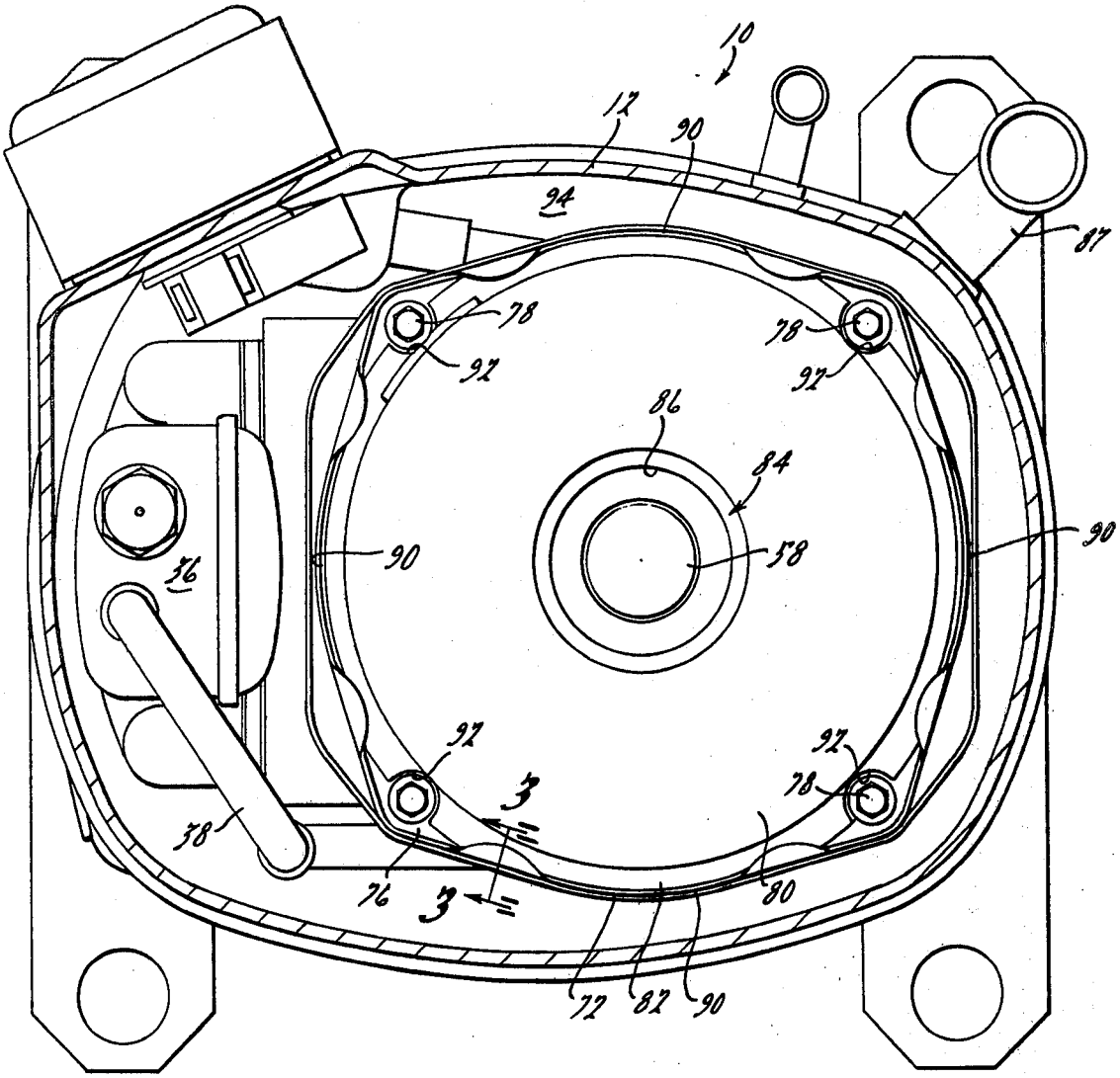
FIG. 2 is a top plan view of the refrigeration compressor of FIG. 1 with portions removed therefrom.

As seen in FIG. 1, a relatively small air gap 88 is provided between the rotor structure and the stator core portion. It is extremely important that the stator structure be positioned and secured to the housing with air gap 88 being uniform around the entire circumference. Thus, in assembling such refrigeration compressors, it is common to first assemble the stator structure 60 and securing bolts 78 to the compressor unit to which a rotor structure 56 has previously been assembled. Next, the stator structure 60 is accurately positioned with respect to rotor 56 so as to provide a uniform air gap therebetween such as by the use of a feeler gauge or any other suitable measuring device. Once the stator 60 has been accurately positioned, securing bolts 78 are tightened thereby retaining the stator 60 in position. Thereafter, the shroud member 80 is placed over the upper end of the motor and the outwardly extending flange portion 82 provided at the open end thereof brought into engagement with body portion 76 of the fastening device 72. In order to retain the motor shroud member in position thereon, flange portion 74 of fastening device 72 is crimped or folded inwardly at a plurality of locations as best seen in FIG. 2 so as to overlie and clamp the outwardly extending flange portion 82 provided on the shroud member 80. Preferably, this crimping operation is accomplished in one step by bringing a die or the like into engagement with flange portion 74 so as to simultaneously form a plurality of crimped portions.

Figure 4:
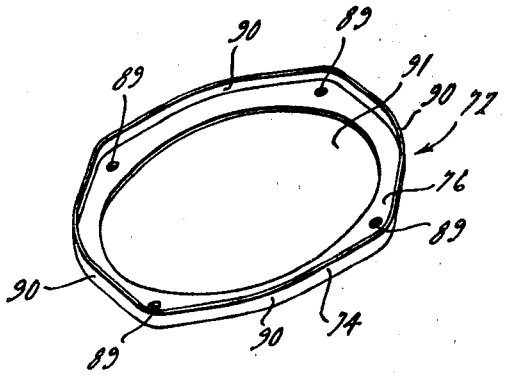
FIG. 4 is a perspective view of the fastening device of the present invention.

As best seen in FIGS. 2 and 4, fastening device 72 is generally circular in shape having outwardly bowed outer edge portions 90. The radius of curvature of outwardly bowed edge portions 90 is substantially equal to or slightly greater than the radius of the shroud member 80 thus insuring that the upwardly extending flange portion 74 will be in close proximity to the outwardly extending flange portion 82 provided on the shroud member 80.

Also, as shown in FIG. 4, upwardly extending flange portion 74 extends around the entire periphery thereof. Relatively small diameter apertures 89 are provided adjacent each corner of fastening device 72 and are adapted to receive bolts 78. A large diameter aperture 91 is also centrally disposed in body portion 76 thereof and allows fastening device 72 to be placed over windings 62 of stator 60. Also, as best seen in FIG. 2, the shroud member is provided with a plurality of generally semicircular cutouts 92 to provide clearance between the stator and fastening device securing bolts 78 thereby allowing the flange portion 82 provided thereon to fully engage the flat portion 76 of the fastening device.

Figure 3:
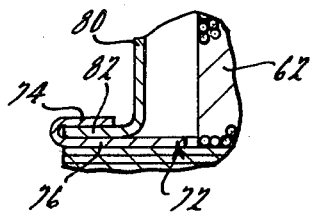
FIG. 3 is an enlarged fragmentary sectional view of a portion of the compressor of FIG. 2, the section being taken along line 3—3 of FIG. 2.

FIG. 3 shows an enlarged sectional view of this securing engagement between the fastening device 72 and shroud member 80. As seen therein, the flange portion 74, being locally deformed in the area immediately surrounding the area in which the section view is taken, is tightly crimped down upon and securingly engages the outwardly extending flange portion 82 provided on the shroud member 80. In the particular example shown in FIG. 2, the shroud member 80 is securely crimped in eight locations. It should be noted, however, that greater or lesser numbers of crimping locations as desired may be provided around the periphery of the shroud member 80 or the flange portion 74 of the fastening device 72 may be deformed around the entire periphery thereof. In any event, the use of this fastening device greatly facilitates the assembly of the refrigeration compressor by allowing the air gap 88 to be precisely set prior to the assembly of the shroud 80. Further, the fastening device 72 eliminates the need to provide additional fasteners such as bolts or the like to secure shroud member 80 over the stator structure 60.

In operation, suction gas will be directed into the interior 94 of the outer shell 12 through the suction gas inlet 87 provided on the side portion thereof. The suction gas will then be allowed to expand within the interior 94 of the shell 12 thus causing entrained oil or lubricant contained therein to be separated therefrom. This refrigeration gas will then circulate through the opening 86 provided in the bottom of the recess 84 of the shroud member 80 and be directed downwardly through the air gap 88 of the motor between the rotor and stator structures 56 and 60 thereby serving to cool the motor. As this gaseous refrigerant flows down through the air gap 88 of the motor 54, it will continue into the lower area 96 defined by the motor 54 and housing structure 14. A passage 98 is provided in the housing structure 14 extending diagonally from lower area 96 toward and communicating with cylinder inlet chambers 26 and 28 provided in cylinder head 24. The suction gas will then be drawn through valves in valve plate 34 into cylinders 16 and 18 where it is compressed by pistons 20 and 22 and expelled through exhaust valves in valve plate 34 into chambers 30 and 32 in head 24. The gas will then pass through chamber 100 and upwardly through the exhaust muffler 36 and outward therefrom into the discharge conduit 38. As seen in FIG. 1, the discharge conduit 38 extends downwardly and has a lower portion 102 which makes a loop around the lower compartment of the shell exiting through discharge exit 104 provided in the shell 12. As the lower portion 102 of this discharge conduit 38 is disposed within a lubrication sump 105 provided within the shell of the compressor, heat will be transferred from the discharge gas to the lubricant thereby aiding in the removal of dissolved refrigeration gas from the lubricant. Further, the lubricant will provide an additional dampening function to the lower portion 102 of discharge gas conduit member 38 as it passes therethrough.

It should also be noted that the shroud member 80, in addition to serving to direct substantially all of the suction gas through the motor 54 for cooling purposes, also performs a suction muffling function with regard to the gas passing therethrough by attenuating the pulsating suction noises created by the reciprocation of the pistons.

Another embodiment of the present invention is illustrated in FIGS. 5 and 6. As seen therein, a refrigeration compressor 106, similar to that described with reference to FIGS. 1 through 3, is shown therein having a stator 108 secured to a lower housing structure 110 and surrounding a rotor 112 secured to a rotating crankshaft 116. Also, similar to that described with reference to FIG. 1, there is a relatively small air gap 118 between the rotor 112 and stator structure 108 which must be uniform around the circumference and hence necessitates that the stator be accurately positioned with respect to the rotor. This may be accomplished in the same manner as described above with reference to FIG. 1. Similarly, a fastening device 120 is provided for retaining a shroud 122 enclosing one end of rotor stator structures 112 and 108. The installation and operation of fastening device 120 is substantially identical to that described with reference to fastening device 72 in FIGS. 1 through 3. However, in this case shroud 122 overlying the motor is provided with a slightly differently shaped recess 124 having a closed bottom 126.

A suction gas directing member 128 comprising a generally tubular shaped portion 130 with an outwardly flared end portion 132 is provided on shroud member 122 along one side thereof. Preferably, this suction gas directing member will be positioned adjacent to and axially aligned with a suction gas inlet 134 extending through the outer shell 136 of the compressor unit. Suction gas directing member 128 serves to more efficiently direct the suction gas into the motor compartment 138 defined by the stator and shroud members 108 and 122 respectively while still allowing a space 140 therebetween within which the suction gas is allowed to expand thereby aiding in separating any entrained oil therefrom. Further, the centrifugal action of rotor 112 rotating within the stator structure 108 will tend to prevent any liquid refrigerant gas from passing therethrough until such time as the heat produced by the driving motor has an opportunity to evaporate this liquid refrigerant. The gaseous refrigerant will then be passed across the top or upper end of the motor structure cooling the end winding a 142 of the stator 108 as well as the upper portion of the rotor 112. The suction gas is then directed through suction gas conduit members 144 and 146 secured to the side wall portion 148 of shroud member 122. Suction gas conduit members 144 and 146 are spaced circumferentially from suction gas directing member 128 and serve to direct the suction gas from motor compartment 138 to a cylinder head 150 secured to lower housing unit 110 and into communication with compressor means disposed therein. Suction gas conduit members 144 and 146 are preferably secured to openings 152 and 154 provided in shroud member 122 such as by clinching or flaring the inner end portion 156 thereof.

Shroud member 122 will be secured by crimping flange portion 158 of fastening device 120 such as shown at 160 in FIG. 5 and as described above. In this particular embodiment, fastening device 120 engages a flange member 162 disposed over the top of stator structure 108. Flange member 162 cooperates with a plurality of bolts 164 extending downward therethrough adjacent the outer surface of stator structure 108 to thereby clamp stator structure in position against housing portion 110. It should also be noted that suction gas directing member 128 provided on the shroud 122 may be employed in the embodiment illustrated in FIGS. 1 through 3 and will function substantially in the same manner. Suction gas directing member 128 may be either integrally formed with shroud member 122 or may be in the form of a separate conduit member secured thereto such as by welding, crimping, or in any other suitable manner. In either event, suction gas directing member 128 serves as an effective means of communicating the suction gas with the interior of the motor compartment 138 for both muffling of the suction gas and cooling of the motor while still providing a space 140 between the suction gas inlet and suction gas directing member 128 to effectively separate entrained oil from the suction gas as well as to separate liquid refrigerant which may also be carried by the suction gas.

It should be noted that the term "air gap" as used herein is a term of art used to designate the space between the rotor and stator of an electric motor. In the compressors disclosed herein this space will be filled with refrigerant gas rather than air.

Thus, as is apparent, the present invention discloses means for securely retaining a shroud over one end of a motor without requiring additional fasteners or additional machining operations to be performed on the stator or housing. Also, the addition of the suction gas directing member greatly improves the efficiency of the compressor in assuring smooth suction gas flow within the compressor while still providing a space for expansion of the suction gas to separate entrained lubricant and/or liquid refrigerant. This suction gas directing member also insures that substantially all of the refrigerant will be passed over the motor thereby insuring cool, efficient operation thereof.

While it will be apparent that the preferred embodiments of the invention disclosed are well calculated to provide the advantages and features above stated, it will be appreciated that the invention is susceptible to modification, variation and change without departing from the proper scope or fair meaning of the subjoined claims.

I claim:

1. A refrigeration motor/compressor comprising:

a hermetic shell having a suction gas inlet;

compressor means within said shell;

an electric motor having a rotor drivingly connected to said compressor means and a stator having one axial end engaging said compressor means:

a shroud fastening device engaging the opposite axial end of said stator;

fasteners securing said shroud fastening device and said stator to said compressor means;

a shroud member enclosing said opposite axial end of said stator and having an inlet opening therethrough, said shroud fastening device retaining said shroud in position;

a tubular member having one end secured to said shroud in communication with said inlet opening and the opposite end outwardly flared; and at least one conduit member external of said motor for communicating suction gas from said shroud to said compressor means, whereby said tubular member and said conduit member cooperate to direct suction gas from said suction gas inlet to said compressor means across said opposite end of said motor to thereby cool said motor and attenuate the noise of said suction gas.

2. A motor/compressor as set forth in claim 1 wherein said fastening device has a generally flat stator engaging portion and a peripheral flange portion extending generally perpendicularly outwardly from said flat portion.

3. A motor/compressor as set forth in claim 2 wherein said shroud member has an outwardly projecting annular flange portion, said annular flange portion being clamped between said flat portion of said fastening device and said peripheral flange portion at a plurality of spaced apart locations.

4. A motor/compressor as set forth in claim 1 wherein said inlet opening is the sole suction gas inlet into said shroud member.

5. A motor/compressor as set forth in claim 1 wherein said outwardly flared end of said tubular member is disposed in coaxial alignment with said suction gas inlet.

6. A motor/compressor as set forth in claim 5 wherein said outwardly flared end of said tubular member is spaced from said suction gas inlet.

7. A hermetic motor/compressor assembly comprising a hermetically sealed shell, a compressor and motor within said shell, said compressor including a housing, said motor having a rotor operably connected to said compressor and having a stator surrounding said rotor, stator securing means clampingly attaching said stator to said housing with one end of the stator engaging said housing, and a shroud member enclosing the opposite end of said stator, characterized by a shroud fastening device separate from said shroud member and from said stator securing means, integral mechanical securing portions carried by said shroud fastening device, integral mechanical securing portions carried by said shroud member and interengaged with said first mentioned mechanical securing portions, said shroud fastening device being secured to said opposite end of said stator by said stator securing means; said shroud member being secured to said shroud fastening device independently of said stator securing means.

8. A motor/compressor assembly as set forth in claim 7 wherein said shroud fastening device and shroud are of generally annular form and said mechanical securing portions comprise perimetric flange portions securingly interengaged to retain said shroud member.

9. A motor/compressor assembly as set forth in claim 7 wherein said shroud member has an outwardly projecting generally annular flange portion, said shroud member being retained by mutual engagement of said annular flange portion and said shroud fastening device, said shroud fastening device having a generally annular peripheral flange portion and a body portion, said last mentioned peripheral flange portion and said body portion of the shroud fastening device cooperating to clamp said annular flange portion of the shroud member therebetween.

10. A motor/compressor assembly as set forth in claim 7 wherein said shroud member has an outwardly projecting generally annular flange portion, said shroud member being retained by mutual engagement of said annular flange portion and said shroud fastening device, a separate flanged member disposed between said stator and said shroud fastening device, said stator securing means comprising bolt-type fasteners extending through said fastening device and flanged member so as to clamp the same together and secure said stator to said housing.

* * * * *

UNITED STATES PATENT AND TRADEMARK OFFICE

CERTIFICATE OF CORRECTION

PATENT NO. : 4,412,791

DATED : November 1, 1983

INVENTOR(S) : Mahendra Lal

It is certified that error appears in the above-identified patent and that said Letters Patent are hereby corrected as shown below:

Column 3, line 16, "33" should be -- 22 --.

Column 3, line 46, "88" should be -- 68 --.

Column 6, line 37, "winding a" should be -- windings --.

Signed and Sealed this

Seventh Day of February 1984

[SEAL]

*Attest:*

GERALD J. MOSSINGHOFF

*Attesting Officer*

*Commissioner of Patents and Trademarks*